United States Patent [19]

Eitzinger

[11] Patent Number: 4,847,988

[45] Date of Patent: Jul. 18, 1989

[54] AUTOMATIC FLIP TOP CAP COVER MACHINE

[75] Inventor: Robert Eitzinger, Long Grove, Ill.

[73] Assignee: Mid-West Automation Systems, Inc., Buffalo Grove, Ill.

[21] Appl. No.: 251,193

[22] Filed: Sep. 29, 1988

[51] Int. Cl.[4] ..... B23P 21/00

[52] U.S. Cl. ..... 29/710; 29/773; 29/821; 29/822

[58] Field of Search ..... 29/710, 717, 718, 773, 29/783, 785, 786, 789, 790, 792, 793, 796, 797, 821, 822, 823

[56] References Cited

U.S. PATENT DOCUMENTS

| | | | |
|---|---|---|---|
| 2,653,745 | 9/1953 | Huntar et al. | 29/773 X |
| 2,972,184 | 2/1961 | Andrew | 29/773 |
| 3,255,519 | 6/1966 | Zabroski et al. | 29/823 |
| 3,328,873 | 7/1967 | Schweers | 29/710 |
| 3,750,256 | 8/1973 | Elmer | 29/710 |
| 4,523,377 | 6/1985 | Spletzer et al. | 29/773 |

*Primary Examiner*—Joseph M. Gorski

*Attorney, Agent, or Firm*—Laff, Whitesel, Conte & Saret

[57] ABSTRACT

The invention provides an automatic machine for closing flip-top caps of a type which is used on toothpaste tubes, for example. The machine has a pair of superimposed turntables separated by a star wheel, the turntables and star wheel turning as a unit about a common axis. The star wheel has a plurality of pockets distributed around the periphery thereof to receive the flip-top caps after they are molded and while the covers are still in the open position in which they were molded. Each of the turntables has an actuator positioned over a corresponding pocket on the star wheel. Cams surround the turntables to raise and lower the actuators at selected locations. As they raise and lower, the covers are flipped over to close the caps.

16 Claims, 2 Drawing Sheets

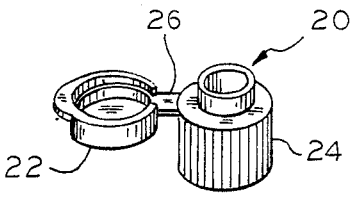
FIG. 1
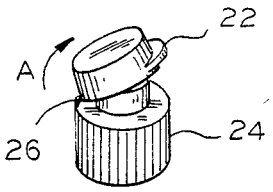
FIG. 2
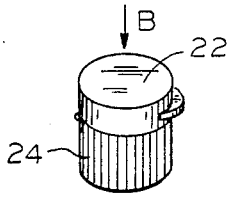
FIG. 3
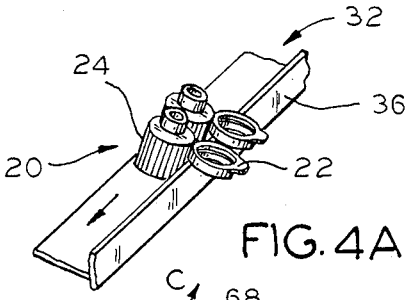
FIG. 4A
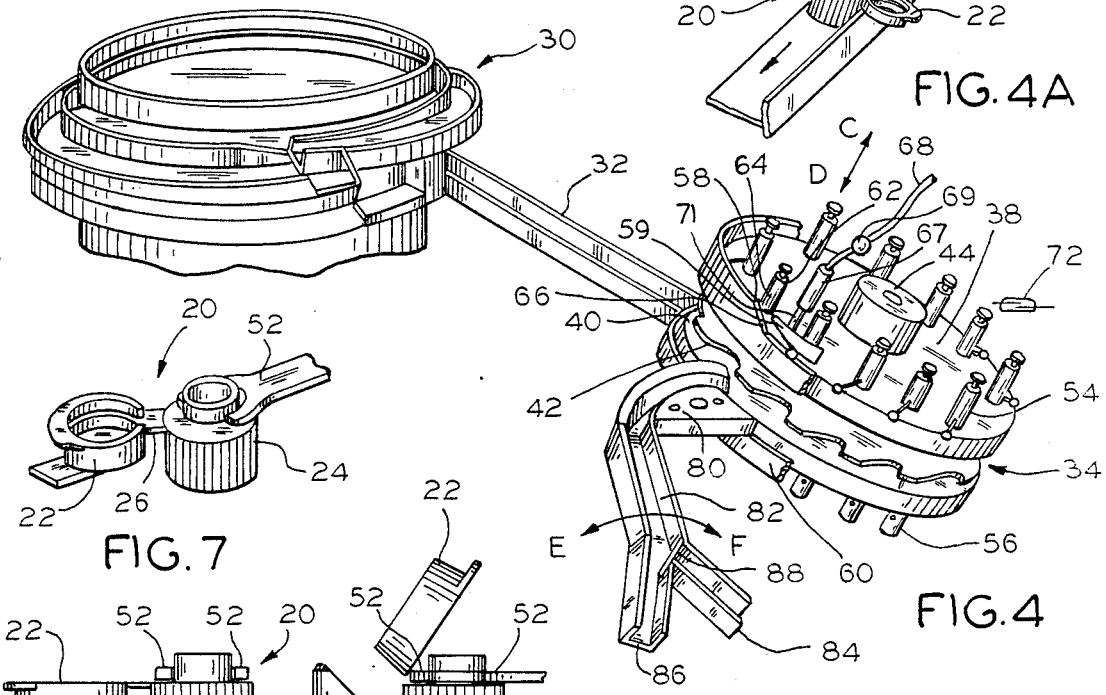
FIG. 4
FIG. 7
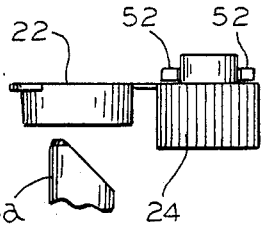
FIG. 8
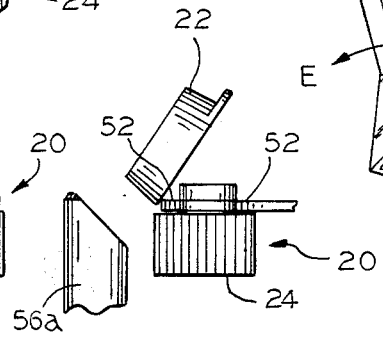
FIG. 9
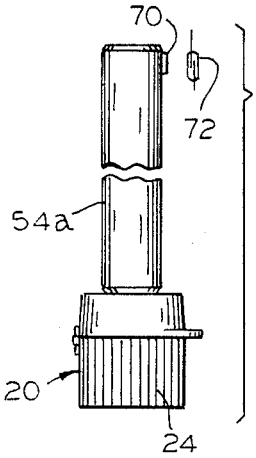
FIG. 10
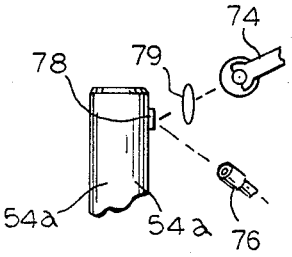
FIG. 11
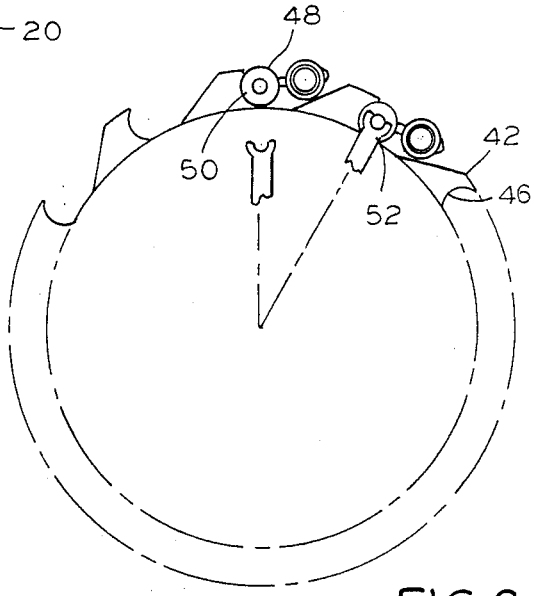
FIG. 6

AUTOMATIC FLIP TOP CAP COVER MACHINE

This invention relates to automatic cap closure machines, and more particularly to machines for closing flip-top caps.

Recent advances in packaging have introduced "flip-top" caps which may be used on toothpaste tubes and similar devices. A flip-top cap is a unitary plastic part which usually has an internally threaded barrel part which may be fastened to the top of a toothpaste tube, for example. The top of the barrel has a cover hinged thereto in order to flip between two positions to open and close the top of the barrel.

The flip-top cap has to be an extremely low cost item owing to the high volume often required by industry. Also, many of the products sold in the packaging with flip-top caps are of relatively low cost, so that even a small fraction of a cent of excess cost for the cap might raise the retail price of the product sufficiently high to destroy the market for the product.

Usually, the flip-top cans are molded in a relatively large mold having in the order of forty to fifty or more cavities. The geometry of the mold cavities produce flip-top caps with the cover in a fully open position. Before the cap may secure the product in the tube, the cover must be flipped over the barrel to the closed position. This should be done to multiple caps simultaneously, rather than to each cap sequentially, to save time and avoid increasing the cost of the cap. Heretofore, the cap closure has been accomplished by the combination of an action mold, for mechanically pushing the cover up from the mold, an air blast for moving the cover most of the way toward the closed position, and a final mechanical device for fully closing the cover. However, action molds are expensive and air blasts cool the mold and flip-tops, thereby increasing the chance that the hinge of the flip-top will crack or break during the closing process.

Frequently with the prior devices, the caps are not fully closed and reopen seconds later. Detection of incompletely closed caps usually depends on visual inspection. Also, since the closing process occurs while the caps are still in the mold, the mold cycle time is increased, making the entire process more costly.

Accordingly, an object of the invention is to provide new and improved means for and methods of closing flip-top caps. Here, an object is to ensure the closures of the caps in a simple, reliable, and low cost manner.

Another object of the invention is to eliminate the need for action molds. Yet another object is to eliminate the use of heat dissipating blasts of air in the vicinity of a hot mold.

In keeping with an aspect of the invention, these and other objects are accomplished by a closure machine having a star wheel transport that is loaded from an orienting feeder. The star wheel moves the flip-top caps around a path between upper and lower actuators which are cam controlled. While traveling around the path, a first actuator is raised from below to move the cover of the flip-top up and to an over-center position. Then, a second actuator is lowered from above to snap the cover into a closed position over the threaded barrel. A sensor measures how far the second actuator moves downwardly and thereby confirms that the closure is completed. If the closure is not completed, the second actuator stops short of its proper ending position and the sensor causes the improperly closed cap to be rejected.

A preferred embodiment of the invention is shown in the attached drawing wherein:

FIGS. 1–3 are three stop motion views showing the closing of the flip-top cap, as the cover moves from the open top condition in which the cap is molded to the closed condition in which it is used;

FIG. 4 schematically shows, in perspective, the essential parts of the inventive machine;

FIG. 4A shows flip-top caps moving along a discharge chute toward a closure head;

FIG. 6 is a plan view of a star wheel which is used to transport flip-top caps through the inventive machine;

FIG. 7 shows, in perspective, a hold down tool used to hold the flip-top cap during the closing thereof;

FIGS. 8–10 are three stop motion views showing the activities of FIGS. 4, 5 closing the flip top cap; and FIG. 11 shows a photocell sensor for detecting closed flip-top caps.

Figure 5:
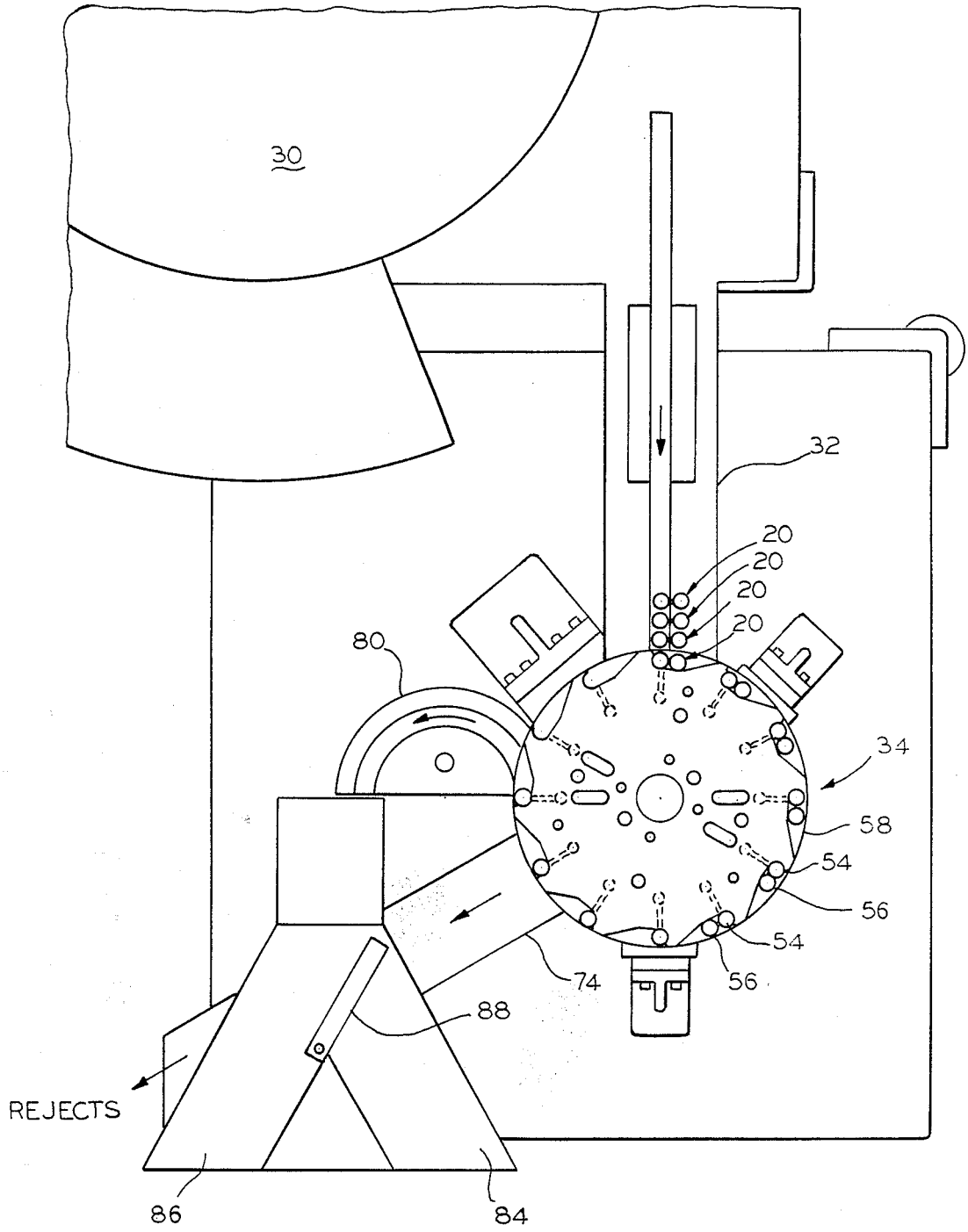
FIG. 5 is a plan view of the machine of FIG. 4.

A flip-top cap 20 (FIG. 1) is usually molded in a cavity which causes the top or cover 22 to stand out to the side and near the top of an internally threaded barrel 24, the cover being joined to the barrel by a hinge 26. This device 20 is a single, unitary part which is usually formed in a large mold, having, perhaps, forty to fifty cavities.

After the cap is molded, the cover 22 must be rotated in direction A (FIG. 2) on the hinge 26 to an over center position so that when pushed down (direction B, FIG. 3), it will snap shut over the top of barrel 24. Once the flip-top cover is completely shut, over the top of barrel 24, it may be handled by automatic machines in the same manner that traditional bottle and tube caps are handled, where there is no flip-top.

Heretofore, the machinery for closing flip-top caps has been built into the mold itself. However, action molds are expensive, and are even more expensive when the mold has such a large number of cavities.

According to the invention, the flip-top caps are removed from the mold while they are still in the open position (FIG. 1). Then, they are dumped, in bulk, into the hopper of a conventional vibrational feeder 30 (FIGS. 4, 5) which orients them so that they all lie in the same relative position as shown in FIG. 1. While in such a uniform orientation, they are fed through a delivery or feeder chute 32, where they move in a single file toward a work station where there is a flip-top cap closure head 34. As shown in FIG. 4A, while in the chute 32, the flip-top 20 may be held in orientation by an upstanding track 36, with the barrel 24 on one side of the track, the flip-top cover 22 on the other side, and the hinge straddling the track. The cover is at an approximately 180 degree angle relative to the barrel, with a tolerance of ±20 degrees.

The closure head 34 has upper and lower turntables 38, 40. For convenience of expression, the terms "upper" and "lower" as applied to the turntables are used to cover any suitable angle of orientation of the turntables. A star wheel 42 is positioned between the turntables 38,40, all of which are mounted to turn as a unit about the hub 44. The star wheel (FIG. 6) has a series of pockets (one of which is numbered 46) formed at equal intervals around the periphery thereof. Each of these pockets is adapted to receive one flip-top cap as it passes out the end of discharge chute 32. For example, one cap 48 is shown in FIG. 6 as having been received by pocket 50. As soon as a cap is received, a forked member 52 radially mounted on star wheel 42 moves forward and into a hold down position (FIG. 7) to secure and control the cap during the closing steps.

Mounted on each of the turntables 38, 40, at positions over and under the pockets 46 on the star wheel are a plurality of upper and lower actuators, two of which are, respectively, numbered 54, 56. The actuators move up and down (FIG. 4 directions C, D), perpendicularly with respect to the surfaces of the turntables. A cam 58, 60 surrounds each of the turntables to selectively move the actuators. For example, actuator 62 has a cam follower 64 which is shown as extending perpendicularly from actuator 62 and riding on inclined surface 66 of the cam 58 in order to raise the actuator 62. At other positions in the rotation of turntable 38, the cam follower 64 riding on cam 58 causes the actuator 62 to lower. Suitable springs (not shown) may be supplied to urge the actuator to follow the cam. Each actuator has a corresponding cam follower.

The actuators carried by the lower turntable 40 also have cam followers and operate in the same manner, being raised and lowered by the cam 60 as the turntable rotates. Desirably, the actuators of the lower turntable are chamfered at the ends contacting the cover 22 (see FIGS. 8 and 9), to provide longer and smoother contact between the actuators and the cover. This is important because the caps should be closed soon after molding and while they are still warm to avoid breakage, and at that time the plastic material is often still soft. Breakage of the hinge is avoided with a gentle and gradual closing motion. The chamfer angle may vary according to the size of the cover, but a 22 degree angle from the vertical has been found generally satisfactory.

The operation of the actuators is illustrated in the stop motion of FIGS. 8–10. The star wheel 42 and turntables 38, 40 rotate as a unit, carrying the actuators 54, 56 past the cams 58, 60. Each pocket 46 on the star wheel 42 receives one cap 48 as it passes the end of chute 32. Once the cap 48 is received, the hold down member 52 advances radially across the star wheel to vertically secure the cap in the pocket.

An actuator 56*a* (FIGS. 8, 9) located on lower turntable 40 is positioned beneath the flip-top 22 of each cap 20 while it is in a star wheel pocket 50. Another actuator 54*a* located on the upper turntable 38 is positioned over each threaded barrel 24 (FIG. 10). At the station where the cap is received, cam 60 holds the lower actuator 56*a* in a lowered position (FIG. 8), so as not to interfere with the receipt of cap 20 from the chute 32. As the turntables 38, 40 and star wheel 42 turn, the lower cam 60 moves the lower actuator 56*a* upwardly (FIG. 9) to raise the flip-top cover 22 to an over-center position. At this point, the lower actuator 56*a* is lowered, leaving cover 22 in its raised position. Next, the upper cam 58 (FIG. 4) moves upper actuator 54*a* (FIG. 10) down over the upstanding cover 22. As upper actuator 54*a* moves down, the hold down member 52 is withdrawn. This action by upper actuator 54*a* snaps the cover 22 of the flip-top into a mostly closed position.

As shown in FIG. 4, an air cylinder 67 is connected to a sectional cam 59 positioned above one or more cam followers at a fixed location near the periphery of the turntables 38,40 and star wheel 42. Preferably, the sectional cam 59 is located at that point above cam 58 where the cam followers are lowest and the upper actuators have had a full opportunity to close the covers 22 to the extent possible. An air source (not shown) is connected via hose 68 through an air pressure regulator 69 to a closing piston 71 in the air cylinder 67. The air pressure is applied to the air cylinder 67 to hold the closing piston 71 down to contact the cam follower of each of the upper actuators as it passes beneath it. The corresponding upper actuator finally snaps the cover 22 shut.

The amount of air pressure is adjustable and, hence, the closing force applied to the piston is likewise adjustable, depending upon the closing resistance of the caps.

When the cover snaps shut at the lower-most position of the upper actuator 54*a*, a sensor 70, 72 completes a circuit to indicate a successful closing of the cap, which leads to a normal discharge of an acceptable product.

If the flip-top cap does not completely close, the partially open cover prevents the upper actuator 54*a* from traveling far enough to trip the sensor 70, 72. When this happens and sensor 70, 72 does not give a signal, a circuit is completed to discharge the improperly closed cap, as a reject. In FIG. 10, the sensor is shown as a magnet 70 mounted on upper actuator 54*a* and a reed contact 72 positioned adjacent the end of actuator 54*a* in its lower most position, which indicates a properly closed and an acceptable product.

An alternative sensor shown in FIG. 11 is a photodiode 74 and photocell 76 combination. For example, a reflective spot 78 is located on actuator 54*a* at a position which is indicative of a properly closed cover on a flip-top cap. The sensor diode 74 provides a light source focused on reflector 78 by lens 79. A photocell 76 is positioned to receive the light reflected from the spot 78, if the upper actuator 54*a* has moved far enough to properly close the flip-top cover.

If the cap does not close properly and if the upper actuator 54*a* does not lower far enough to trip the sensor 72, the improperly closed cap is removed from the star wheel, and discarded through chute 74 (FIG. 5), as by air blowing or any suitable means.

At a proper location during their travel in the pockets 50 on star wheel 42, the properly closed caps are discharged into an exit track 80 leading to two acceptable product discharge chutes 84, 86. A deflector or door 88 may swing back and forth in directions E, F (FIG. 5) to divert the acceptably closed caps to either of the chutes 84, 86 and to bar them from entering the other chute.

Sensors similar to those described above can be located on the exit track to detect open covers, or elsewhere along the feeder chute 32, around the star wheel 42, or along the exit track 80 to count the passing number of caps.

The invention has been found to be extremely efficient. It is highly unlikely that a partially open cap will be discharged into the chute with fully closed caps, since the caps are individually inspected. The number of caps closed within a certain time period depends on the cap size, but for 15 millimeter diameter caps the invention can easily close 300 caps per minute. The invention has been operated at speeds up to 600 pieces per minute. Importantly, the closing process occurs independently of the mold, leaving the mold free for production of additional caps. One of the inventions can service several molding machines.

Those who are skilled in the art will readily perceive how to modify the invention. Therefore, the appended claims are to be construed to cover all equivalent structures which fall within the true scope and spirit of the invention.

The claimed invention is:

1. An automatic machine for closing flip-top caps having covers hinged to threaded barrels, comprising: means for uniformly orienting said caps to travel through a delivery chute toward a work station, means at said work station for receiving said caps one at a time from said delivery chute, means for transporting said received caps over a predetermined path within said work station, upper and lower actuator means for selectively moving at least part of said caps as said caps are transpoted over said path, cam controlled means operating said lower actuator means for raising said cover to an over-center position above said threaded barrel, and cam controlled means for lowering said upper actuator means to press said cover into a closed position over said threaded barrel.

2. The machine of claim 1 and sensor means associated with at least one of said upper and lower actuator means for detecting how far said upper actuator means is lowered in order to discriminate between properly and improperly closed caps, and means for discharging improperly closed caps as rejects and for discharging properly closed caps as acceptable products.

3. An automatic machine for closing flip-top caps having covers hinged to threaded barrels, said machine comprising upper and lower turntables, a star wheel between said turntables for carrying said flip-top cans, said turntables and said star wheel turning as a unit about a common axis, actuators on each of said turntables for reciprocal movement toward and away from said star wheel, cams surrounding said upper and said lower turntables to raise and lower said actuators at selected locations as said unit turns about said common axis, said actuators sequentially pushing said covers of said flip-top caps to an over-center position relative to their respective barrels to which they are hinged and then pushing said covers into a closed position over their barrels.

4. The machine of claim 3 and an air powered piston spaced apart from said turning star wheel for urging the actuator nearest to said piston to fully close said covers.

5. the machine of claim 3 and hold down means mounted on said star wheel to retain said barrel in position at least during the period while said cover is being pushed to said over-center position.

6. The machine of claim 5 and detector means for detecting the position of an actuator when it is supposed to snap said cover into said closed position, and means responsive to said detected position of said actuator for rejecting improperly closed flip-top caps.

7. The machine of claim 6 wherein said detector means comprises magnets and a reed contact, one of said magnets being mounted on each of said actuators and said contact being located adjacent a position where one of said actuators is located when a cover is snapped into a closed position over said threaded barrel.

8. The machine of claim 6 wherein said detector means is a light source and a photocell, and whereby the amount of light falling on said photocell depends on the position of said actuator relative to the cover at the time said cover is to be closed.

9. The machine of claim 3 and a delivery chute, means for orienting said flip-top caps to feed them through said delivery chute to said star wheel, and whereby said star wheel has a plurality of pockets on the periphery thereof to receive individual caps as they are presented by said delivery chute.

10. The machine of claim 9 wherein said delivery chute has an upstanding track and said flip-top caps are oriented with said cover on one side of said track and said threaded barrel on the other side of said track, said pockets receiving said flip-top caps as they are oriented by said track.

11. The machine of claim 1 wherein each of said turntables has said actuators mounted perpendicularly thereon at positions which are the same radial distance from said common axis and at positions which are equally spaced around said turntables, said positions being adjacent said pockets on said star wheel, said actuators on the lower turntable being positioned under the covers of the flip-top caps in said pockets and said actuators on the upper turntable being positioned over the threaded barrels of the flip-top caps in said pockets.

12. The machine of claim 11 and cam followers on each of said actuators, said cam followers being positioned to engage said cams surrounding said turntables whereby said cams push said cam followers to raise and lower said actuators as a function of their position as said turntables turn.

13. The machine of claim 12, wherein improperly closed covers on said flip-top caps prevent said actuators from being in a proper position when said covers are supposed to snap shut, means responsive to said detector means for rejecting a flip-top cap when its cover is improperly closed, and means also responsive to said detecting means for accepting a flip-top cap when its cover is properly closed.

14. The machine of claim 13 wherein said detector means is a magnet on each of said actuators and a reed contact fixed in a spaced apart relationship to said actuators.

15. The machine of claim 13 wherein said detector means is a light source and photocell, the light of said source being focused at a portion of one of said actuators which is visible to said photocell when said actuator properly snaps said cover into said closed position on said flip-to cap.

16. The machine of claim 3 wherein said actuators on each of said turntables continuously reciprocate while said turntables and star wheel turn.

* * * * *